US010036618B2

(12) United States Patent
Yamada et al.

(10) Patent No.: US 10,036,618 B2
(45) Date of Patent: Jul. 31, 2018

(54) IGNITER

(71) Applicant: DAICEL CORPORATION, Osaka (JP)

(72) Inventors: Ryohei Yamada, Prachinburi (TH); Takaya Masumoto, Hyogo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 15/686,071

(22) Filed: Aug. 24, 2017

(65) Prior Publication Data

US 2017/0350679 A1 Dec. 7, 2017

Related U.S. Application Data

(63) Continuation of application No. PCT/JP2016/055375, filed on Feb. 24, 2016.

(30) Foreign Application Priority Data

Feb. 25, 2015 (JP) ..... 2015-035593

(51) Int. Cl.
*F42B 3/117* (2006.01)
*F42D 1/04* (2006.01)
(Continued)

(52) U.S. Cl.
CPC ..... *F42B 3/117* (2013.01); *F42B 3/10* (2013.01); *F42C 7/00* (2013.01); *F42D 1/04* (2013.01)

(58) Field of Classification Search
CPC .. F42B 3/10; F42B 3/117; F42B 3/195; F42C 7/00; F42C 19/08; F42D 1/04
(Continued)

(56) References Cited

U.S. PATENT DOCUMENTS 4,066,415 A * 1/1978 Kasama ..... B01J 7/00 102/531
4,515,080 A * 5/1985 Bell ..... F42B 3/113 102/205
(Continued)

FOREIGN PATENT DOCUMENTS

CH 681175 A5 1/1993
FR 1124185 A 10/1956
(Continued)

OTHER PUBLICATIONS

International Search Report issued in related application PCT/JP2016/055375 dated May 17, 2016.
(Continued)

*Primary Examiner* — James S Bergin
(74) *Attorney, Agent, or Firm* — Knobbe Martens Olson & Bear LLP

(57) ABSTRACT

An igniter includes a first ignition charge, a first member which has a predetermined inner surface and a second member. The second member is arranged in a state of being inserted into the first member and which has a predetermined outer surface opposed to the predetermined inner surface in an arrangement state, for forming a predetermined space to arrange the first ignition charge between the predetermined inner surface and the predetermined outer surface. When the second member is rotated with respect to the first member, then the first ignition charge is ignited in the predetermined space by means of a predetermined pressure including a shear force generated between the predetermined outer surface and the predetermined inner surface in accordance with the rotation, and a combustion product of the first ignition charge is released from an opening of the predetermined space. Accordingly, preferable ignition of the ignition charge is realized.

6 Claims, 5 Drawing Sheets

(51) Int. Cl.
*F42C 7/00* (2006.01)
*F42B 3/10* (2006.01)

(58) Field of Classification Search
USPC ..... 102/200, 205
See application file for complete search history.

(56) References Cited

U.S. PATENT DOCUMENTS

| | | | | |
|---|---|---|---|---|
| 4,846,067 | A | 7/1989 | Martin | |
| 6,537,245 | B1 | 3/2003 | Alexandre et al. | |
| 2006/0201369 | A1* | 9/2006 | Kuroda | F42B 3/103 102/289 |
| 2006/0278115 | A1* | 12/2006 | Juy | F42B 8/26 102/487 |
| 2017/0343021 | A1* | 11/2017 | Yamada | F42B 3/12 |

FOREIGN PATENT DOCUMENTS

| | | | |
|---|---|---|---|
| JP | H06-031346 | Y2 | 2/1994 |
| JP | 2014-025655 | A | 2/2014 |

OTHER PUBLICATIONS

International Preliminary Report on Patentability (English translation) dated Aug. 29, 2017 in International Application No. PCT/JP2016/055375, filed Feb. 24, 2016.

* cited by examiner

IGNITER

CROSS-REFERENCE TO RELATED APPLICATIONS

This application is a continuation application, and claims the benefit under 35 U.S.C. §§ 120 and 365 of PCT Application No. PCT/JP2016/055375, filed on Feb. 24, 2016, which is hereby incorporated by reference. PCT/JP2016/055375 also claimed priority from Japanese Patent Application No. 2015-035593 filed on Feb. 25, 2015, the entire contents of which are incorporated by reference.

TECHNICAL FIELD

The present disclosure relates to an igniter.

BACKGROUND ART

A pyrotechnic actuator mechanism, which is an actuator mechanism to obtain an output by moving a piston by means of the force of an ignition charge, is used for apparatuses including, for example, an airbag system for vehicles, a pedestrian protection system, a current breaker, a perforator, and a fire extinguishing system. Further, a syringe, which discharges or injects an injection objective substance by means of a pressurized piston, is also known in the field of medical treatment. A pyrotechnic actuator mechanism is widely investigated as a driving source for the syringe as described above. An igniter, which ignites an ignition charge, is carried as a driving source to obtain an output in the actuator mechanism as described above.

In this context, the igniter has been hitherto widely developed. When the igniter is roughly classified, there are an electric type igniter and a mechanical type igniter. In the case of the electric type igniter, the ignition charge is electrically ignited by means of an ignition current supplied from the outside. The supply of the ignition current is controlled relatively easily. Further, the ignition current can be supplied to a large number of igniters at once. Therefore, the electric type igniter is especially useful when it is intended to arbitrarily control the ignition of each of the igniters in a system which includes a large number of the igniters. On the contrary, the electric type igniter requires, for example, a power source for supplying the ignition current and a control device for controlling the supply. It is inevitable that the system is large or complicated.

On the other hand, in the case of the mechanical type igniter, the energy for igniting the ignition charge is obtained from any mechanical motion or operation not from the ignition current. For example, as described in Patent Literature 1, the friction force is generated between a friction member 7 and a first ignition charge 8 by pulling out a pin 12. The first ignition charge 8 is ignited by the energy thereof, and propellants or explosives 6, 15 are successively combusted. Further, as in a syringe described in Patent Literature 2, an end portion 8 of a friction member 11 is rubbed with an ignition charge 2 in accordance with a depressing operation for depressing a button 3 performed by a user. The ignition charge 2 is ignited by the friction energy generated thereby. Then, an injection solution is discharged or injected by the combustion energy generated by the ignition.

PRIOR ART LITERATURES

Patent Literatures

Patent Literature 1: Switzerland Patent Publication No. 681175

Patent Literature 2: U.S. Pat. No. 6,537,245

SUMMARY

Problems to be Solved

In the case of the conventional mechanical type igniter, the ignition of the ignition charge is performed by utilizing the friction energy generated by the relatively linear motion including, for example, the depression and the pulling out of the friction member performed by the user. However, the friction force, which acts between the friction member and the propellant or explosive in accordance with the linear motion, easily varies depending on, for example, the state of contact between the both. Therefore, it is not easy to appropriately adjust the friction energy generated by the linear motion as described above. If the friction force between the friction member and the ignition charge is excessively weak, then any sufficient friction energy is not generated, and it is difficult to ignite the ignition charge. On the other hand, if the friction force is excessively strong, then the operability of the igniter is deteriorated or lowered, or it is feared that the igniter may be broken on account of any operation of the user.

Accordingly, in view of the problems described above, an object of the present disclosure is to provide a mechanical type igniter which realizes preferable ignition of an ignition charge.

Means for Solving the Problems

In order to solve the problems as described above, according to the present disclosure, a mechanical type igniter has such a structure that a pressure, which includes a shear force (shearing force), is applied to an ignition charge as the energy for igniting the ignition charge, and made it possible to stably supply the energy for the ignition to the ignition charge. Specifically, the present disclosure resides in an igniter comprising a first ignition charge; a first member which has a predetermined inner surface; and a second member which is arranged in a state of being inserted into the first member and which has a predetermined outer surface opposed to the predetermined inner surface in an arrangement state, for forming a predetermined space to arrange the first ignition charge between the predetermined inner surface and the predetermined outer surface. Then, in the igniter, the second member is arranged in the arrangement state so that the second member is rotatable with respect to the first member about a center of an axis of insertion of the second member in the arrangement state, in a state in which the first ignition charge is interposed in the predetermined space; and the predetermined space has an opening which is communicated with outside of the predetermined space in an axial direction of the axis of insertion. Accordingly, when the second member is rotated with respect to the first member, then the first ignition charge is ignited in the predetermined space by means of a predetermined pressure including a shear force generated between the predetermined outer surface and the predetermined inner surface in accordance with the rotation, and a combustion product of the first ignition charge is released from the opening of the predetermined space.

Any ignition charge can be adopted for the first ignition charge which is used for the igniter according to the present disclosure, provided that the ignition charge is ignitable when the predetermined pressure including the shear force is applied as described above. The ignition charge is exemplified, for example, by ZPP (mixture of zirconium and potassium perchlorate) and black powder (for example, boron saltpeter). Then, the ignition charge is arranged in the predetermined space which is defined by the predetermined inner surface of the first member and the predetermined outer surface of the second member. The predetermined space is the space which is defined by the both surfaces in the arrangement state formed by inserting the second member into the first member. The predetermined space has the opening which is communicated with the outside of the predetermined space, in addition to the surfaces.

Then, in the arrangement state, the second member is in such a state that the second member is rotatable with respect to the first member. Then, when the second member is rotated with respect to the first member, the both members are relatively rotated in the state in which the first ignition charge is interposed in the predetermined space. As a result, both surfaces of the predetermined inner surface and the predetermined outer surface are relatively moved so that the shear force is applied to the first ignition charge during the rotational motion. As a result, the predetermined pressure, which includes the relatively large shear force, can be stably applied to the first ignition charge. It is possible to reliably ignite the first ignition charge. Note that the combustion product, which is produced by the ignition and the combustion of the first ignition charge, does not stay in the predetermined space. The combustion product is released to the outside via the opening of the predetermined space. The energy (thermal energy and kinetic energy) of the combustion product released to the outside is the primary output of the igniter.

In this way, the igniter according to the present disclosure adopts such an arrangement that the predetermined pressure, which includes the shear force, is applied to the ignition charge arranged in the predetermined space by the aid of the predetermined inner surface and the predetermined outer surface in accordance with the mechanical motion which is the rotational movement of the second member with respect to the first member. The shear force, which is based on the rotation, makes it possible to stably supply the energy for the ignition to the first ignition charge, as compared with any ignition technique which utilizes the friction force based on the linear motion as adopted in the conventional technique. Therefore, it is easy to perform the production management including the management of, for example, the dimensional tolerance of the parts of the igniter. Further, it is possible to realize the reliable ignition as expected for the igniter.

In this context, the igniter may further comprise a regulating portion which regulates separation of the second member from the first member in the direction of the axis of insertion when the second member is rotated with respect to the first member and the first ignition charge is ignited. There is such a possibility that the first member and the second member may receive the pressure in the directions in which the first member and the second member are separated from each other, from the combustion product which is produced when the first ignition charge is ignited in the predetermined space. In view of the above, the separation of the both is regulated by providing the regulating portion, and it is possible to suppress the igniter from being subjected to the breakage or the like after the ignition. Note that the regulating portion regulates the separation of the first member and the second member in the axial direction of the axis of insertion in every sense. The regulating portion does not inhibit the rotation of the second member with respect to the first member.

In this context, as an example of the regulating portion, the regulating portion may be the predetermined inner surface and the predetermined outer surface which are formed to provide protrusion and recess in a cross section taken in the axial direction of the axis of insertion. In this case, when the first ignition charge is ignited, then the predetermined inner surface and the predetermined outer surface are brought in contact with each other, and thus the separation of the second member from the first member is regulated. That is, the predetermined inner surface and the predetermined outer surface, which are arranged to form the protrusion and recess, are engaged or meshed with each other upon the ignition of the first ignition charge, and thus the both surfaces function as the regulating portion.

Further, as another example of the regulating portion, when the predetermined inner surface is a screw thread portion of the first member which is a female screw member; and the predetermined outer surface is a screw thread portion of the second member which is a male screw member; then the regulating portion may be formed by the first member and the second member which are screw-engaged with each other. That is, when the first member as the female screw member and the second member as the male screw member are screw-engaged with each other, a state is given, in which the screw threads of the both are engaged or meshed with each other. Therefore, it is possible to regulate the separation of the both members in the direction of the axis of insertion, while the rotation of the second member with respect to the first member is sufficiently secured or guaranteed. Note that in this form, the space, which is provided between the screw thread portions of the first member and the second member, is the predetermined space. When the second member is rotated with respect to the first member, the predetermined pressure including the shear force, which acts between the both screw thread portions, is applied to the first ignition charge. Accordingly, the ignition thereof is caused.

In this context, the igniter as described above may further comprise a second ignition charge which is ignitable by the combustion product and which is arranged at a predetermined portion capable of being brought in contact with the combustion product of the ignition charge released from the opening in the vicinity of the opening of the predetermined space. The first ignition charge is arranged in the predetermined space as described above. Therefore, it is difficult in some cases to increase the amount of the arranged ignition charge. Further, the ignition is performed by the predetermined pressure including the shear force in the predetermined space. Therefore, it may be also difficult to relatively increase the amount of the first ignition charge from such a viewpoint that the ignition is preferably performed. On this account, there is also such a possibility that it is not easy to increase the output as the igniter by using only the first ignition charge.

In view of the above, the second ignition charge is arranged at the position which is different from the position of the first ignition charge, i.e., at the predetermined portion at which the first ignition charge is released. Accordingly, it is possible to raise or enhance the output as provided by the igniter. Note that any arbitrary ignition charge can be adopted for the second ignition charge, provided that the ignition charge is ignitable by the combustion product of the first ignition charge. For example, it is also allowable to adopt an ignition charge which has the same quality as that of the first ignition charge, or it is also allowable to adopt an ignition charge which is different from the first ignition charge. Then, preferably, the combustion energy, which is generated by the second ignition charge, is set to be larger than the combustion energy which is generated by the first ignition charge. It is possible to preferably raise the output as the igniter by further raising the combustion energy of the second ignition charge as described above.

In this context, the igniter described above may further comprise a communication passage which is formed for at least one of the first member and the second member and which makes communication between the predetermined space and the predetermined portion at which the second ignition charge is arranged. When the predetermined space and the predetermined portion are communicated with each other by means of the communication passage, then the combustion product of the first ignition charge can be thereby delivered smoothly to the second ignition charge which is arranged at the predetermined portion, and it is possible to contemplate the preferred combustion of the second ignition charge.

It is possible to provide the mechanical type igniter which realizes preferable ignition of the ignition charge.

EMBODIMENTS

An embodiment of the present disclosure will be explained below with reference to the drawings. Note that the structure or construction of the following embodiment is described by way of example, and the present disclosure is not limited to the structure or construction of the embodiment.

<Structure of Igniter 10>

Figure 1:
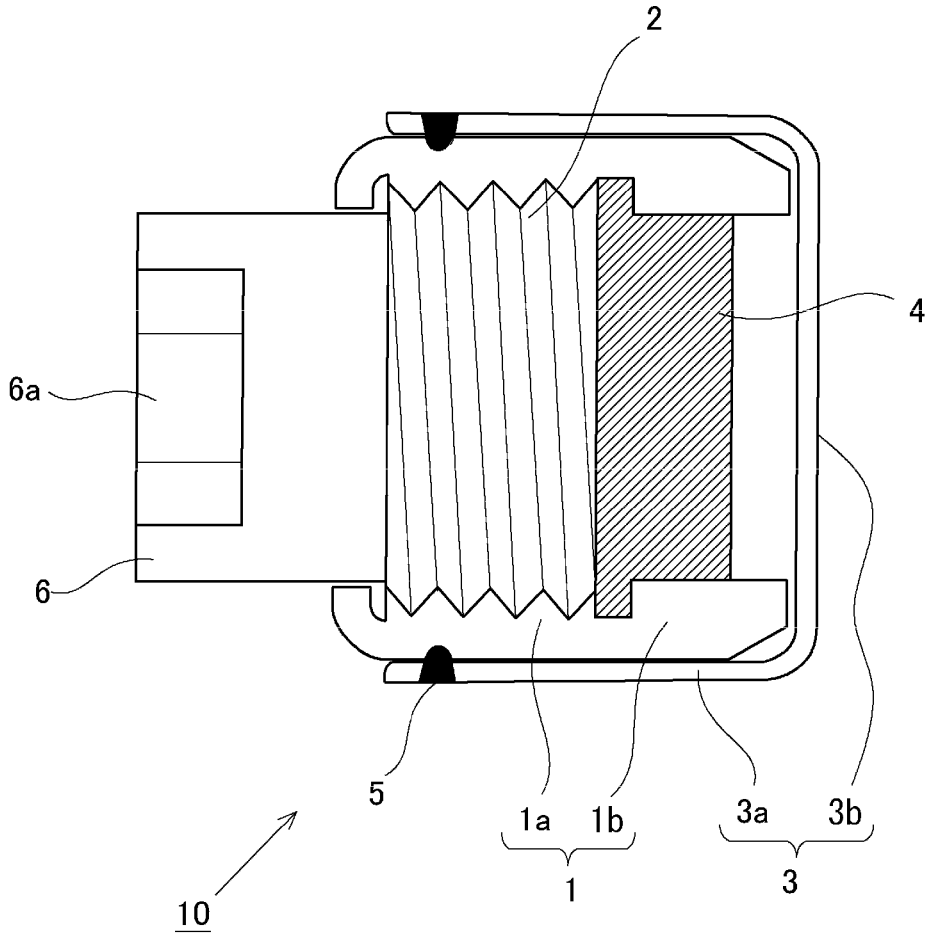
FIG. 1 shows a schematic structure of an igniter according to the present disclosure.
Figure 2A:
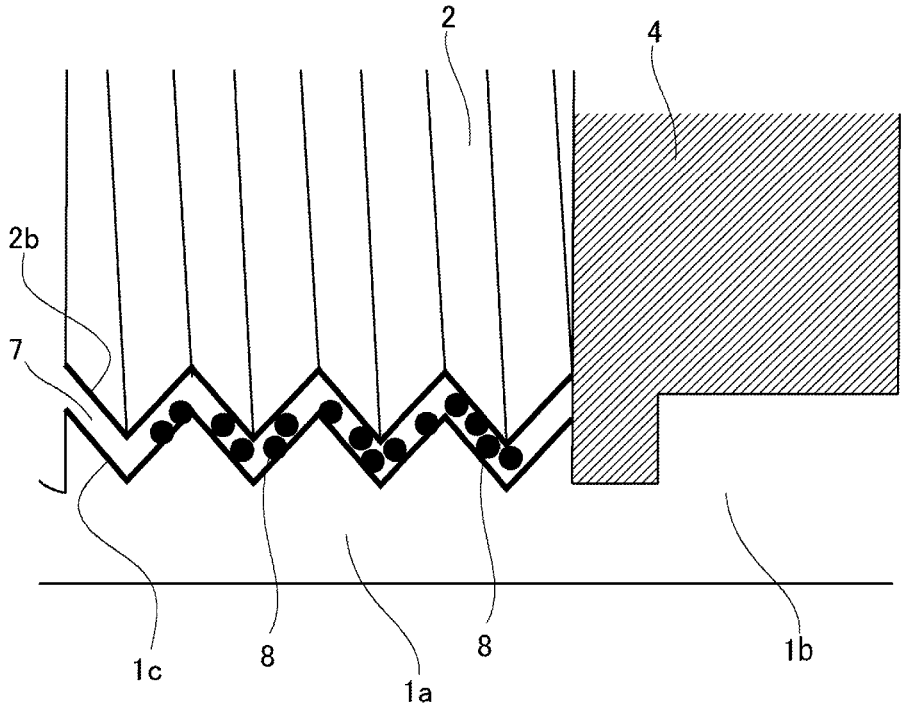
FIG. 2A illustrates an ignition structure for igniting an ignition charge in the igniter shown in FIG. 1.
Figure 2B:
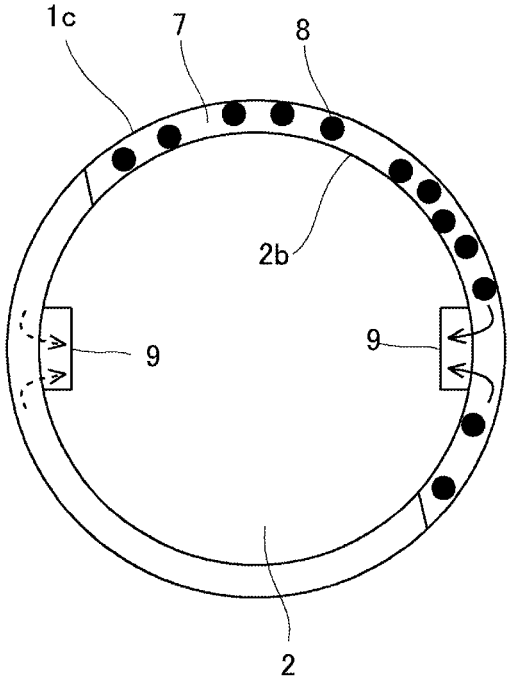
FIG. 2B illustrates an ignition structure for igniting an ignition charge in the igniter shown in FIG. 1.

FIG. 1 shows a schematic structure of an igniter 10 according to the present disclosure. Further, in FIG. 2, a part of the igniter 10 shown in FIG. 1 is enlarged in order to easily grasp the structure in relation to the ignition means for igniting an ignition charge in the igniter 10. Further, FIG. 2A shows a sectional view taken in the direction of the axis of insertion in relation to the igniter 10 in the same manner as FIG. 1, and FIG. 2B shows a sectional view taken in the direction perpendicular to the direction of the axis of insertion. Note that the axis of insertion refers to the axis extending in the direction of insertion in a state in which a second member 2 is inserted and arranged with respect to a first member 1 as described later on in the igniter 10 (hereinafter simply referred to as "arrangement state").

The igniter 10 shown in FIG. 1 is a mechanical type igniter, and the igniter 10 is placed in an arrangement state brought about before a first ignition charge 8 charged into the inside thereof (see FIG. 2) is ignited. Therefore, when the mechanical force is allowed to act from the outside on the igniter 10 which is placed in this arrangement state, the ignition is thereby performed for the first ignition charge 8 charged therein. In this arrangement, the main body of the igniter 10 is formed by the first member 1 and the second member 2. The first member 1 has a screw thread which is formed such that the inner surface thereof functions as a female thread at an insertion portion 1*a* into which the second member 2 is inserted. The inner surface of the first member 1, which is formed by the screw thread of the female screw, is referred to as "screw thread surface 1*c*" as depicted in FIG. 2A. The screw thread surface 1*c* corresponds to the predetermined inner surface according to the present disclosure. On the other hand, the second member 2, which is inserted into the first member 1, has a screw thread which is formed such that the outer surface thereof functions as a male thread. The outer surface of the second member 2, which is formed by the screw thread of the male screw, is referred to as "screw thread surface 2*b*" as depicted in FIG. 2A. The screw thread surface 2*b* corresponds to the predetermined outer surface according to the present disclosure.

The first member 1 and the second member 2, which have the screw thread surfaces 1*c*, 2*b* as described above, are formed with the respective screw thread surfaces so that the first member 1 and the second member 2 can be screw-engaged with each other by the aid of the mutual screw thread surfaces. Then, in order to arrive at the arrangement state shown in FIG. 1, the second member 2 is progressively inserted so that the second member 2 is advanced from the left side to the right side as viewed in FIG. 1, while slowly rotating and screw-engaging the second member 2 with respect to the first member 1. The axis, which extends in the direction of insertion of the second member 2, is the axis of insertion described above. Note that a second ignition charge 4 is arranged in a state provided before the insertion of the second member 2, at the portion 1*b* (hereinafter referred to as "forward end portion") disposed on the forward end side of the first member 1 (right side as viewed in FIG. 1). Therefore, the insertion of the second member 2 into the first member 1 is performed until arrival at the position at which the forward end of the second member 2 is brought in contact with the second ignition charge 4.

Further, a handle portion 6, which has a sufficient length to such an extent that the handle portion 6 protrudes from the first member 1 even in a state in which the second member 2 is inserted into the first member 1, is attached to a portion of the second member 2 disposed on a proximal end side (left side as viewed in FIG. 1) so that the second member 2, which is formed as the male screw member, can be rotated at the inside of the first member 1. Therefore, the second member 2 is inserted into the first member 1 by rotating the handle portion 6. Note that a recess 6*a* is provided at a central portion of the handle portion 6. A part or a tool, which is provided to rotate the handle portion 6, is fitted thereto, making it possible to perform the rotation operation for rotating the handle portion 6 more easily.

Further, in the arrangement state shown in FIG. 1, the second member 2 is attached to the first member 1 after being inserted into the first member 1 so that a cup 3 covers the forward end side of the first member 1, in other words, the cup 3 covers the second ignition charge 4. The cup 3 has a top surface 3*b* which is arranged opposingly to the second ignition charge 4 and a side surface 3*a* which is formed to have an annular form so that the side surface of the first member 1 is covered therewith. The top surface 3*b* is the portion which is to be cleaved by the combustion product produced when the igniter 10 is operated. In order to cause the cleavage easily, it is possible to form a fragile portion having a strength weaker than those of the surroundings. Then, the side surface 3*a* of the cup 3 and the first member 1 are fixed by means of the welding. In FIG. 1, the welding portion is referred to by reference numeral 5. Note that the welding portion 5 is formed in an annular form between the side surface 3*a* of the cup 3 and the first member 1 in order to suppress the invasion of moisture into the igniter 10 which would be otherwise caused on account of the welding. Note that another method is also available as the technique to fix the cup 3. That is, a protruding portion is provided on the inner side of the side surface 3*a* of the cup 3, the protruding portion is fitted into a recess provided on the side surface of the first member 1, and thus the first member 1 is fixed to the cup 3. In this case, in order to avoid the invasion of moisture, it is preferable to apply a sealing agent between the side surface 3*a* and the first member 1. Further, when the cup is subjected to the fitting by means of the protruding portion and the recess as described above, it is preferable to determine the shapes and the sizes of the protruding portion and the recess so that the cup 3 is not disengaged by the pressure generated by the combustion of the respective ignition charges.

An explanation will now be made about the charge of the first ignition charge 8 in the igniter 10. As shown in FIG. 2A, a minute space 7 is formed between the first member 1 and the second member 2 which are in a relationship of being screw-engaged with each other. That is, in the arrangement state, the screw thread surface 1*c* as the inner surface of the first member 1 and the screw thread surface 2*b* as the outer surface of the second member 2, which are opposed to one another, are not in such a state that the mutual surfaces are completely brought in contact with each other. Microscopically, as shown in FIG. 2A, the space 7 is formed to such an extent that particles or granules of the first ignition charge 8 can be charged. Therefore, the screw engagement relationship between the first member 1 and the second member 2 is not provided to generate the fastening force brought about by the screw engagement, but the screw engagement relationship is provided in order that the space is formed to such an extent that the first ignition charge 8 can be charged and the second member 2 can be inserted into the first member 1 in accordance with the screw engagement. Note that when the first ignition charge 8 is charged into the space, the first ignition charge 8 may be charged after preparing a slurry form (wet charge) while avoiding any dry state of the first ignition charge 8. For example, as described in Japanese Patent Application Laid-Open No. 2004-115001, an ignition charge can be charged in accordance with such a method that the ignition charge is dissolved in a solvent to prepare a slurry form, the preparation is poured into the space, and then the solvent is dried.

In this context, the space 7, which is formed between the screw thread surface 1*c* and the screw thread surface 2*b*, is the space in which the first ignition charge 8 is charged as described above. The space 7 is formed to surround the second member 2. In this arrangement, the space 7 is open to the side of the forward end portion 1*b* of the first member 1 and the side of the proximal end portion respectively. Then, the opening of the space 7, which is disposed on the side of the forward end portion 1*b*, is in a state of being closed by the second ignition charge 4 arranged at the forward end portion 1*b* as shown in FIG. 2A.

Further, as shown in FIG. 2B, a groove 9, which extends in the direction of the axis of insertion described above, is formed for the second member 2. The groove 9 has a predetermined depth, and the groove 9 is open to the space 7 which is formed between the screw thread surface 1*c* and the screw thread surface 2*b*. Further, the groove 9 is also connected to the space disposed on the side of the forward end portion 1*b* at which the second ignition charge 4 is arranged. That is, the groove 9 is formed so that the space 7 and the space disposed on the side of the forward end portion 1*b* are communicated with each other.

An explanation will be made about the ignition operation of the igniter 10 constructed as described above. Note that in this embodiment, the ignition charges, which have the same components, are used for the first ignition charge 8 and the second ignition charge 4. The ignition charge is exemplified, for example, by a propellant containing zirconium and potassium perchlorate (ZPP), a propellant containing titanium hydride and potassium perchlorate (THPP), a propellant containing titanium and potassium perchlorate (TiPP), a propellant containing aluminum and potassium perchlorate (APP), a propellant containing aluminum and bismuth oxide (ABO), a propellant containing aluminum and molybdenum oxide (AMO), a propellant containing aluminum and copper oxide (ACO), a propellant containing aluminum and iron oxide (AFO), or a propellant composed of a combination of a plurality of the foregoing propellants. These propellants exhibit such characteristics that, although the propellants generate hot and high-pressure plasma during combustion immediately after ignition, when combustion products condense at a room temperature, the propellants do not contain gaseous components and the pressure generated decreases abruptly. It is also allowable that any propellant or pyrotechnic charge other than the above is used as the ignition charge.

In this context, when the handle portion 6 is rotated at a strength which is intense to a certain extent in the arrangement state shown in FIG. 1, the second member 2 is further screw-engaged in the first member 1 in the state in which the first ignition charge 8 is charged in the space 7. In this situation, the screw thread surface 1*c* disposed on the side of the first member 1 and the screw thread surface 2*b* disposed on the side of the second member 2 are progressively moved relatively to one another so that the predetermined pressure, which includes the shear force and the compressive force, is applied to the first ignition charge 8 charged in the space 7. In particular, the relatively large shear force can be generated by rotating the second member 2. It is possible to supply the energy which is sufficient to ignite the first ignition charge 8 charged in the space 7.

When the predetermined pressure is applied to the first ignition charge 8 in accordance with the rotation of the second member 2 as described above, then the first ignition charge 8 is ignited, and the combustion product is produced by the combustion thereof. In this case, the space 7, in which the first ignition charge 8 is arranged, is open to the space disposed on the side of the forward end portion 1*b* at which the second ignition charge 4 is arranged. Therefore, the combustion product flows into the side of the second ignition charge 4 via the opening. Further, as described above, the second member 2 is formed with the groove 9. Therefore, the combustion product, which is produced in the space 7, flows into the side of the second ignition charge 4 via the groove 9 as well. In this way, the combustion product, which is produced by the ignition and the combustion of the first ignition charge 8, is supplied to the second ignition charge 4, and thus the second ignition charge 4 is subsequently ignited and combusted. As for the second ignition charge 4, a relatively large space, in which the second ignition charge 4 is arranged, can be secured as compared with the first ignition charge 8. Therefore, the charge amount of the second ignition charge 4 is an amount to such an extent that the output is determined as provided by the igniter 10. Therefore, the charge amount of the first ignition charge 8 is an amount capable of producing the combustion product in order to ignite and combust the second ignition charge 4.

As described above, in the igniter 10, the predetermined pressure including the shear force is applied to the first ignition charge 8 charged in the space 7 in accordance with the mechanical rotational motion of the second member 2 brought about as the starting point. Accordingly, the first ignition charge 8 and the second ignition charge 4 are successively ignited and combusted, and the output is obtained as the igniter 10. Then, it is possible to secure or guarantee the stable ignition and the combustion of the ignition charge by utilizing the shear force resulting from the rotational motion as described above. Note that when the first ignition charge 8 and the second ignition charge 4 are combusted, the pressure, which corresponds to the combustion energy, is applied to the second member 2. However, the second member 2 is screw-engaged with the first member 1. Therefore, when the pressure is applied, the screw thread surface 1*c* and the screw thread surface 2*b* are engaged or meshed with each other. The separation of the second member 2 from the first member 1 (for example, the movement in the leftward direction as viewed in FIG. 1) is regulated.

<Example of Use of Igniter 10>

In this context, when the igniter 10 is carried on a predetermined apparatus or device, the output thereof can be thereby utilized for a variety of purposes. Accordingly, an explanation will be made on the basis of FIG. 3 about an igniter assembly 15 which is formed by attaching an igniter collar 11 to the igniter 10 in order to easily utilize the output of the igniter 10. The igniter collar 11 is a member which is provided in order that the igniter 10 is attached and fixed to one side (right side as viewed in FIG. 3) of a base plate 11*b* including a through-hole 11*a* formed at the center. Then, the handle portion 6 is arranged by the aid of the through-hole 11*a* on the other side (left side as viewed in FIG. 3) of the base plate 11*b* in a state in which the recess 6*a* is exposed. Note that the igniter 10 is fixed by a resin 12 with respect to the igniter collar 11. The rotational motion of the handle portion 6 is secured or guaranteed in the fixed state.

When the igniter 10 is attached to the igniter collar 11 as described above, the igniter 10 is easily carried on the side of the predetermined apparatus or device by the aid of the igniter collar 11. Further, in the igniter assembly 15, the handle portion 6 and the components or parts relevant to the ignition charge charged in the igniter 10 are arranged with the base plate 11*b* intervening therebetween. Therefore, the combustion product of the ignition charge, especially the combustion product of the first ignition charge 8 hardly arrives at the side of the handle portion 6. The combustion product hardly affects the operation of the igniter 10, i.e., for example, the operation to rotate the handle portion 6 performed by the user in order to cause the ignition. This feature also improves the operability of the igniter 10 operated by the user.

Figure 3:
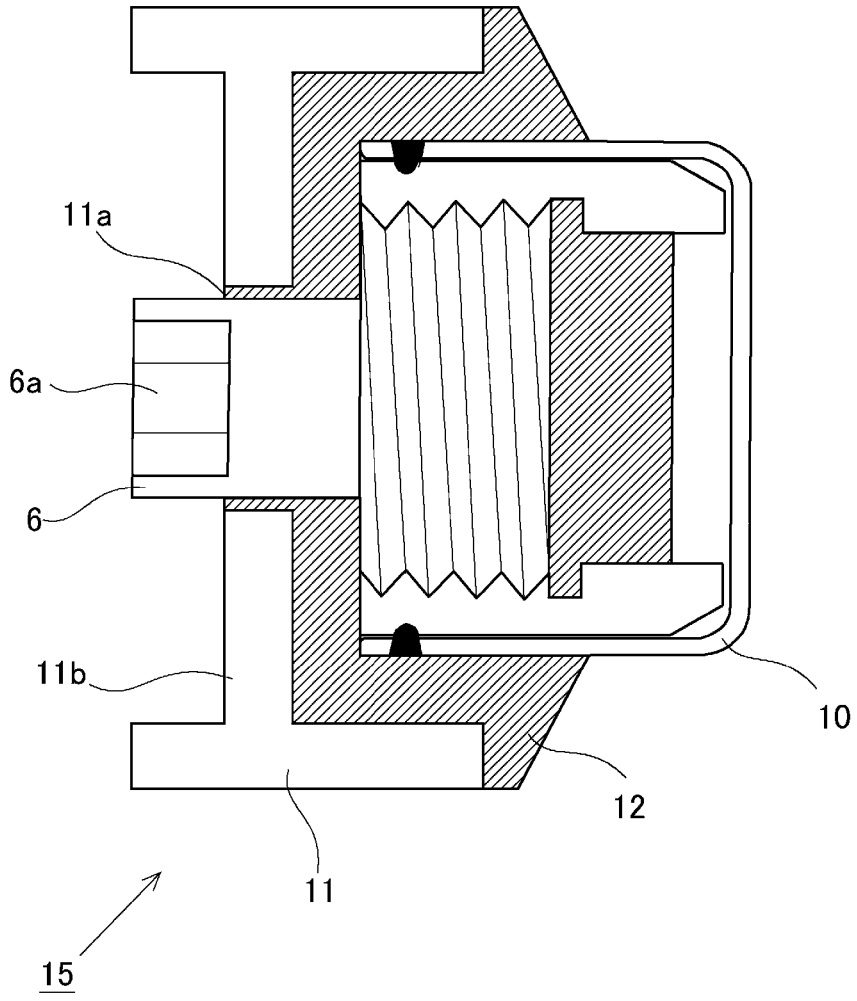
FIG. 3 shows a schematic structure of an igniter assembly formed by attaching an igniter collar to the igniter shown in FIG. 1.
Figure 4:
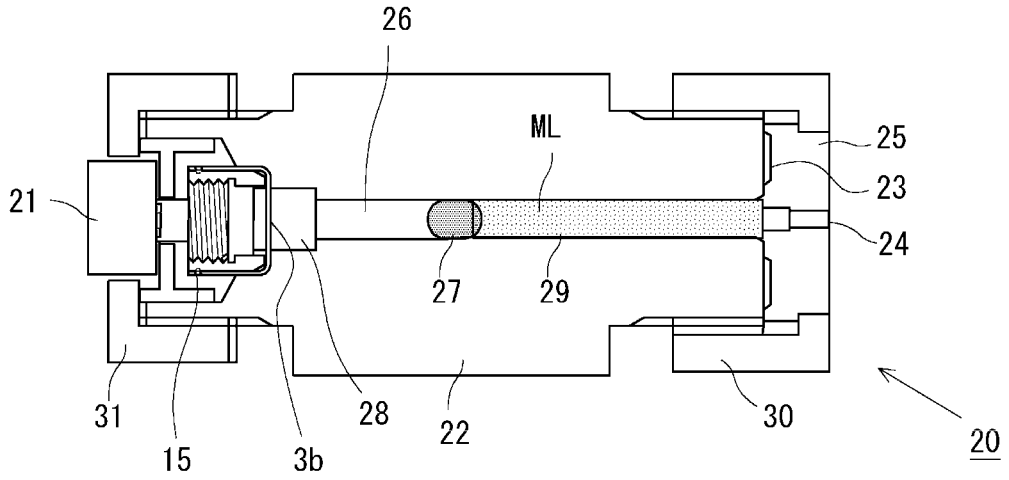
FIG. 4 shows a schematic structure of a syringe to which the igniter assembly shown in FIG. 3 is attached.

An explanation will now be made on the basis of FIG. 4 about a needleless syringe 20 which carries the igniter assembly 15 shown in FIG. 3. FIG. 4 shows a sectional view of the syringe 20. The right side of FIG. 4 is the forward end side of the syringe 20, i.e., the side on which an injection solution is discharged or injected. The left side of FIG. 4 is the proximal end side of the syringe 20, i.e., the side on which the user operates the syringe 20. The syringe 20 has a main syringe body 22. A through-hole 29, which extends in the axial direction and which has a constant diameter in the axial direction, is provided at a central portion of the main syringe body 22. Then, one end of the through-hole 29 is communicated with a combustion chamber 28 which has a diameter larger than the diameter of the through-hole 29. The remaining other end of the through-hole 29 arrives at a nozzle 24. Further, the igniter assembly 15 is installed on the side of the combustion chamber 28 opposite to the communication portion communicated with the through-hole 29 so that the top surface 3*b* of the cup 3 is opposed to the communication portion.

In this case, any additional ignition charge is not especially arranged in the combustion chamber 28 shown in FIG. 4. However, for example, a gas generating agent, which is combusted by the combustion product of the ignition charge to generate the gas, can be also arranged in the combustion chamber 28. As for an example of the gas generating agent, it is possible to exemplify a single base smokeless propellant including 98% by mass of nitrocellulose, 0.8% by mass of diphenylamine, and 1.2% by mass of potassium sulfate. Further, it is also possible to use various gas generating agents used for a gas generator for airbags and a gas generator for seat belt pretensioners. The combustion completion time can be changed for the gas generating agent by adjusting the dimension, the size, and the shape, especially the surface shape of the gas generating agent when the gas generating agent is arranged in the combustion chamber 28. Accordingly, the pressure transition in the combustion chamber 28 can be a desired transition.

In the next place, a piston 26 made of metal is arranged in the through-hole 29 so that the piston 26 is slidable in the axial direction in the through-hole 29. One end thereof is exposed on the side of the combustion chamber 28, and a plunger 27 is integrally attached to the other end. In this arrangement, for example, butyl rubber and silicon rubber can be adopted as the material for the plunger 27. Further, examples of the material include styrene-based elastomer, hydrogenated styrene-based elastomer, and the styrene-based elastomer and the hydrogenated styrene-based elastomer added with polyethylene, polypropylene, polybutene, polyolefin such as α-olefin copolymer, liquid paraffin, oil such as process oil, and powder inorganic matters such as talc, cast, and mica. Further, polyvinyl chloride-based elastomer, olefin-based elastomer, polyester-based elastomer, polyamide-based elastomer, and polyurethane-based elastomer, various rubber materials (in particular, those subjected to vulcanization) such as natural rubber, isoprene rubber, chloroprene rubber, nitrile-butadiene rubber, and styrene-butadiene rubber, mixtures of the kinds of elastomer and the kinds of rubber, and the like can be adopted as the material of the plunger. Further, the plunger 27 has a plurality of annular projections which are formed on the outer circumference of a columnar body. The projections are made of resin, and hence the projections are elastically deformed when the plunger 27 is inserted into the through-hole 29 together with the piston 26. It is possible to enhance the degree of tight contact between the plunger 27 and the inner wall surface of the through-hole 29.

Then, the injection solution ML, which is to be injected by the syringe 20, is accommodated in the space which is formed in the through-hole 29 disposed on the side of the forward end of the syringe as starting from the plunger 27. Note that as shown in FIG. 4, the injection solution ML is not enclosed in a completely closed space, and the forward end side of the syringe is in an open state. However, the inner diameter of the through-hole 29 for accommodating the injection solution ML is extremely small, and the amount of the injection solution is small as well. Therefore, even when the accommodating space for accommodating the injection solution ML is the semi-closed space as described above, the state, in which the injection solution ML is accommodated in the through-hole 29, is preferably retained by the surface tension of the injection solution ML. Then, as described later on, the accommodated injection solution ML is pressurized by the output of the igniter assembly 15, and thus the injection solution ML is discharged or injected from the nozzle 24.

Further, a holder 25, which is formed with a nozzle 24 for discharging or injecting the injection solution ML, is provided on the forward end side of the syringe 20. The holder 25 is fixed to the end surface of the main syringe body 22 while interposing a gasket 23 by the aid of a holder cap 30. The holder cap 30 is formed to have a brim-shaped cross section so that the holder cap 30 is caught or hooked by the holder 25, and the holder cap 30 is screw-fixed to the main syringe body 22. Accordingly, the holder 25 is prevented from being disengaged from the main syringe body 22, which would be otherwise disengaged by the pressure applied to the injection solution ML upon the discharge or injection of the injection solution ML. Further, the igniter assembly 15 is also rigidly attached to the main syringe body 22 by means of a cap 31 provided therefor, and the igniter assembly 15 is prevented from being disengaged. Note that one nozzle 24 may be formed at the center of the holder 25, or a plurality of nozzles 24 may be formed.

In this arrangement, as for the syringe 20, an operation button 21 is attached to the recess 6*a* (see FIG. 3) exposed on the igniter assembly 15. A known mechanical mechanism (for example, a drum cam or the like), which converts the rectilinear motion into the rotational motion, is incorporated into the operation button 21. When the user exerts the force in order to depress the operation button 21 (the upward in FIG. 4 is the depressing direction), the operation button 21 is progressively depressed while being rotated by means of the mechanical mechanism. As a result, the depressing operation to depress the operation button 21 causes the rotational motion of the handle portion 6 of the igniter assembly 15.

In the case of the syringe 20 constructed as described above, the user depresses the operation button 21 in a state in which the forward end of the nozzle 24 is brought in contact with a target (for example, skin surface of arm or leg of the user) into which the injection solution ML is to be injected. In accordance with the operation of the user, the handle portion 6 of the igniter assembly 15 performs the rotational motion (provided that the load is also applied to the handle portion 6 in the depressing direction). The first ignition charge 8 is ignited and combusted by means of the predetermined pressure including the shear force generated between the screw thread surfaces 1*c*, 2*b*. After that, the second ignition charge 4 is subsequently ignited and combusted. As a result, the interior of the combustion chamber 28 is filled with the combustion product, and the pressure is applied to the injection solution ML accommodated in the through-hole 29 by the aid of the piston 26. The pressurized injection solution ML is discharged or injected toward the injection target via the nozzle 24. The pressure is applied to the discharged injection solution ML. Therefore, the injection solution ML penetrates through the surface of the target, and the injection solution arrives at the inside thereof. Accordingly, it is possible to achieve the object or purpose of the injection performed by the syringe 20.

<Modified Embodiments of Igniter 10>

Figure 5A:
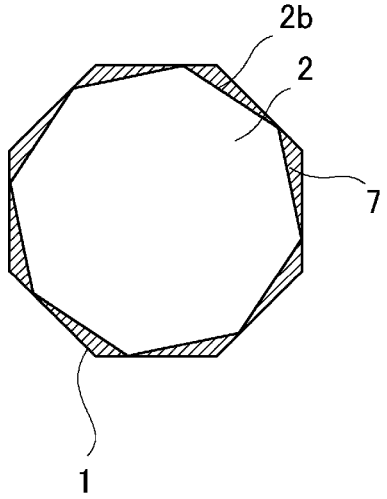
FIG. 5A shows modified embodiments of the igniter according to the present disclosure.

An explanation will be now made on the basis of FIG. 5 about a modified embodiment of the igniter 10. FIG. 5A shows an arrangement state of a first member 1 and a second member 2 in a first modified embodiment. Note that the arrangement state shown in FIG. 5A is provided when the both members are viewed in the direction of the axis of insertion into the first member 1. In this context, in the first modified embodiment, the first member 1 has an inner surface including a cross section formed to be a regular octagon. The second member 2 is inserted into the space formed by the inner surface. Then, the second member 2 has an outer surface including a cross section formed to be a regular octagon in the same manner as described above. Then, a space 7, in which the first ignition charge 8 can be accommodated, is formed between the inner surface of the first member 1 and the outer surface of the second member 2 which are opposed to one another (in FIG. 5A, any illustration of the first ignition charge 8 is omitted).

In the case of the igniter 10 constructed as described above, as shown in FIG. 5A, the second member 2 is brought in contact with the inner surface of the first member 1. Therefore, the second member 2 cannot be rotated freely. However, when such a state is given that the outer surface of the second member 2 is brought in contact with the inner surface of the first member 1 in accordance with the rotation, then the first ignition charge 8 is interposed between the both members, and the predetermined pressure, which includes the shear force and the compressive force, is intensively applied thereto. Therefore, the first ignition charge 8 can be efficiently ignited or inflamed. Thus, the output of the igniter 10 is easily utilized for a variety of purposes in the same manner as in the first embodiment described above.

Figure 5B:
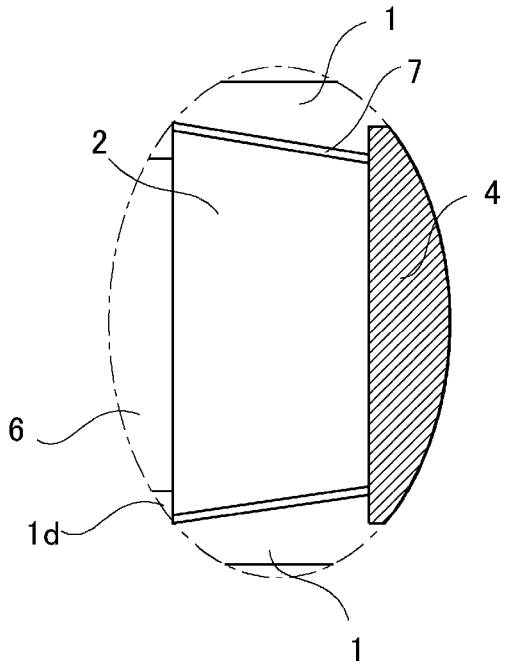
FIG. 5B shows modified embodiments of the igniter according to the present disclosure.

Next, an explanation will be made on the basis of FIG. 5B about a second modified embodiment of the igniter 10. FIG. 5B shows an arrangement state of a first member 1 and a second member 2 in the second modified embodiment. Note that the arrangement state shown in FIG. 5B depicts the state in cross section taken in the direction of the axis of insertion into the first member 1 in the same manner as in FIG. 1. In this context, in the second modified embodiment, the outer surface of the second member 2 is formed to have a circular truncated cone shape, and the inner surface of the first member 1 is also formed to have a circular truncated cone shape corresponding thereto so that the second member 2 can be accommodated. Then, a space 7, in which the first ignition charge 8 can be accommodated, is formed between the inner surface of the first member 1 and the outer surface of the second member 2 which are opposed to one another (in FIG. 5B, any illustration of the first ignition charge 8 is omitted).

Also in the igniter 10 constructed as described above, the first ignition charge 8 accommodated in the space 7 is ignited by rotating the second member 2 by the aid of the handle portion 6. In this arrangement, a stepped portion is formed at the connecting portion between the second member 2 and the handle portion 6 as shown in FIG. 5B, on account of the difference between the diameter of the handle portion 6 and the diameter of the circular truncated cone surface of the second member 2. Further, a protrusion/recess portion 1*d*, which corresponds to the stepped portion, is formed on the side of the first member 1. In this way, the separation of the second member 2 from the first member 1 is regulated by the engagement in the direction of the axis of insertion between the stepped portion disposed on the side of the second member 2 and the protrusion/recess portion 1*d* disposed on the side of the first member 1. Accordingly, even when the pressure is applied to the second member 2 on account of the combustion of the first ignition charge 8 and the second ignition charge 4, the second member 2 is prevented from being separated from the first member 1.

The invention claimed is:

1. An igniter comprising:

a first ignition charge;

a first member which has a predetermined inner surface; and a second member which is arranged in a state of being inserted into the first member and which has a predetermined outer surface opposed to the predetermined inner surface in an arrangement state, for forming a predetermined space to arrange the first ignition charge between the predetermined inner surface and the predetermined outer surface, wherein:

the second member is arranged in the arrangement state so that the second member is rotatable with respect to the first member about a center of an axis of insertion of the second member in the arrangement state, in a state in which the first ignition charge is interposed in the predetermined space;

the predetermined space has an opening which is communicated with outside of the predetermined space in an axial direction of the axis of insertion; and when the second member is rotated with respect to the first member, then the first ignition charge is ignited in the predetermined space by means of a predetermined pressure including a shear force generated between the predetermined outer surface and the predetermined inner surface in accordance with the rotation, and a combustion product of the first ignition charge is released from the opening of the predetermined space.

2. The igniter according to claim 1, further comprising a regulating portion which regulates separation of the second member from the first member in the direction of the axis of insertion when the second member is rotated with respect to the first member and the first ignition charge is ignited.

3. The igniter according to claim 2, wherein:

the regulating portion is the predetermined inner surface and the predetermined outer surface which are formed to provide protrusion and recess in a cross section taken in the axial direction of the axis of insertion; and when the first ignition charge is ignited, then the predetermined inner surface and the predetermined outer surface are brought in contact with each other, and thus the separation of the second member from the first member is regulated.

4. The igniter according to claim 2, wherein:

the predetermined inner surface is a screw thread portion of the first member which is a female screw member;

the predetermined outer surface is a screw thread portion of the second member which is a male screw member; and the regulating portion is formed by the first member and the second member which are screw-engaged with each other.

5. The igniter according to claim 1, further comprising a second ignition charge which is ignitable by the combustion product and which is arranged at a predetermined portion capable of being brought in contact with the combustion product of the ignition charge released from the opening in the vicinity of the opening of the predetermined space.

6. The igniter according to claim 5, further comprising a communication passage which is formed for at least one of the first member and the second member and which makes communication between the predetermined space and the predetermined portion at which the second ignition charge is arranged.

* * * * *